US007468118B2

(12) United States Patent
Magaldi et al.

(10) Patent No.: US 7,468,118 B2
(45) Date of Patent: Dec. 23, 2008

(54) EXTRACTION, DRAINAGE AND TRANSPORT OF PETROLEUM COKE

(75) Inventors: Mario Magaldi, Salerno (IT); Giancarlo Cattaneo, Salerno (IT)

(73) Assignee: Magaldi Ricerche e Brevetti S.r.L., Salerno (IT)

( * ) Notice: Subject to any disclaimer, the term of this patent is extended or adjusted under 35 U.S.C. 154(b) by 735 days.

(21) Appl. No.: 10/501,013

(22) PCT Filed: Jan. 6, 2003

(86) PCT No.: PCT/EP03/00103

§ 371 (c)(1),
(2), (4) Date: Jan. 21, 2005

(87) PCT Pub. No.: WO03/057604

PCT Pub. Date: Jul. 17, 2003

(65) Prior Publication Data

US 2005/0126902 A1 Jun. 16, 2005

(30) Foreign Application Priority Data

Jan. 10, 2002 (IT) ..... MI2002A0030

(51) Int. Cl.
*C10B 25/00* (2006.01)

(52) U.S. Cl. ..... 202/242; 202/262; 202/244; 202/245; 208/132; 414/187; 198/804

(58) Field of Classification Search ..... 202/242, 202/262, 244, 245; 208/132; 414/187; 209/393; 198/495, 804
See application file for complete search history.

(56) References Cited

U.S. PATENT DOCUMENTS

| | | | | |
|---|---|---|---|---|
| 3,912,091 | A * | 10/1975 | Thompson | 414/196 |
| 4,604,019 | A * | 8/1986 | Deering | 414/187 |
| 6,290,494 | B1 * | 9/2001 | Barkdoll | 432/121 |
| 6,565,714 | B2 * | 5/2003 | Lah | 202/245 |
| 7,108,793 | B2 * | 9/2006 | Casey et al. | 210/767 |

* cited by examiner

*Primary Examiner*—N. Bhat
(74) *Attorney, Agent, or Firm*—Olson & Cepuritis, Ltd.

(57) ABSTRACT

A system for the extraction, drainage and wet transport of the petroleum coke produced by the coking chambers is described. Such system provides the collection, drainage and transport of the petroleum coke coming from the coking chambers during the cutting phase all the way to the boilers' feeding. The material extracted from the coking chamber (7) through the use of high pressure water is conveyed on the pre-crusher (4) through a connection system (1*a*). Between the pre-crusher (4) and the draining belt conveyor (2) there is a drainage and containment hopper (1) which has the dual function of accumulation and possible drainage thanks to some holes that serve as weir. The material which falls from above in different sizes, after having being reduced in size by the pre-crusher (4), gets transported by the belt (2) that carries out a first drainage phase through the holes made on the same belt. The coke is collected on the belt while the drained water is collected in a lower collection channel (8). Downstream of the belt (2) there is a further draining belt (3) which sees to finish the drainage phase before transporting the coke towards the boiler's feeding bunkers. Subsequently, downstream of the draining belt (3) there is a rubber belt conveyor (5), which directly provides for storing the material. At last, the water/coke mixture collected into the channel (8) gets sent into a filtering equipment (6) and the filtered material (6*a*) is recycled on one of the draining belts.

10 Claims, 2 Drawing Sheets

EXTRACTION, DRAINAGE AND TRANSPORT OF PETROLEUM COKE

The present invention is about a petroleum coke extraction system from the coking chambers through draining steel belt conveyors.

At the present time, in some plants, the petroleum coke produced at the refineries is extracted from the coking towers through a wet process which utilizes the water as a transport fluid. A brief description of the current process will better explain this procedure.

The coke is produced in appropriate cylindrical reactors wherein, because of the temperature, thermal cracking reactions occur, from which the production of light hydrocarbons (gasoline, gas oil, oil, and gas) and coke are obtained. The light hydrocarbons in the gas form are stripped from the top of the reaction chamber while the coke, which is a byproduct of the process, remains inside the chamber packing from the bottom upwards. As this phase comes to an end, the coke extraction from the reaction chamber follows. First of all, it is necessary to cool the coke with water by gradually filling up the entire chamber thus flooding all the material inside of it. Once the filling up phase is over, the extraction phase begins, which is of greater interest for the simplifications that this invention is attempting to obtain.

After the opening of the chamber the water cutting phase takes place by removing the flange from its lower part. From the top of the chamber a high pressure water drill equipped with lateral and vertical nozzles is introduced. During a first step, the enlargement of the central hole is provided with the use of the vertical nozzles. In the following step, the coke is gradually cut from the top downwards by using the lateral nozzles and thanks to the previously made hole the coke can run down towards the bottom and come out of the chamber. The cutting or decoking phase is a delicate one, because an excessive speed could cause a vast fall of material which could flood the crusher below thus creating some bridges above the same crusher. The latter one is usually a two rollers crusher. The cutting water flow rate is about 200 $m^3/h$ at 180-200 bars.

The water/coke mixture coming from the coking chamber falls towards the bottom and is discharged onto a crusher which sees to reduce the coke at such a size so as to be hydraulically transported through pumps. The connection of the crusher to the coking chambers is made of telescopic cylinders which have the function of holding said mixture in order to avoid the spreading of the material in the surrounding areas.

Below the crusher there is a chute which conveys all the mixture towards a collecting basin from which the mixture on its turn is pumped toward some big containment towers named "hydrobins" that have the function of separating the solid part of the coke from the water.

After this separation the coke is extracted from the hydrobins through rubber belts and stored at the coal store-yard from which is collected afterwards in order to be used in the thermal power plant.

Today these processes have several negative aspects related to:

- Environmental impact, mainly regarding the dustiness connected to the coke storage and the following transport to the boiler's bunkers.
- High costs of the processing. The procedures are very complex.
- Clogging problems during the extraction phase due to the crusher.

The object of the present invention is that of remedying to the inconveniences belonging to the known state of the art.

Therefore the invention's object is that of radically modifying the full process through the elimination of all the previously mentioned negative aspects.

It must be said that some of the processes, as it will be clear afterwards, are worthy even if taken apart from their integration into the petroleum coke extraction and transport process from the coking towers. The new extraction process and the following transport is achieved by a draining belt, which complies at the same time with the functions of extraction and water drainage of the water/coke mixture discharged from the coking towers, and hence it substitutes the hydraulic transport phase and the following coke/water separation phase in the hydrobins.

A brief description of the proposed process will allow to better understand the advantages it offers. Said process regards only the coking towers' downstream part of the plant, and therefore does not include the process inside the very own tower.

In the following description a preferred embodiment of the invention's annexed drawings wherein:

Hence, below the coking tower, in place of the hopper and the crusher moving on a rail, a pre-crusher is placed, it too sliding on a rail, and underneath there is a belt which both are set at work when the decoking phase of anyone of the towers is carried out.

Figure 1:
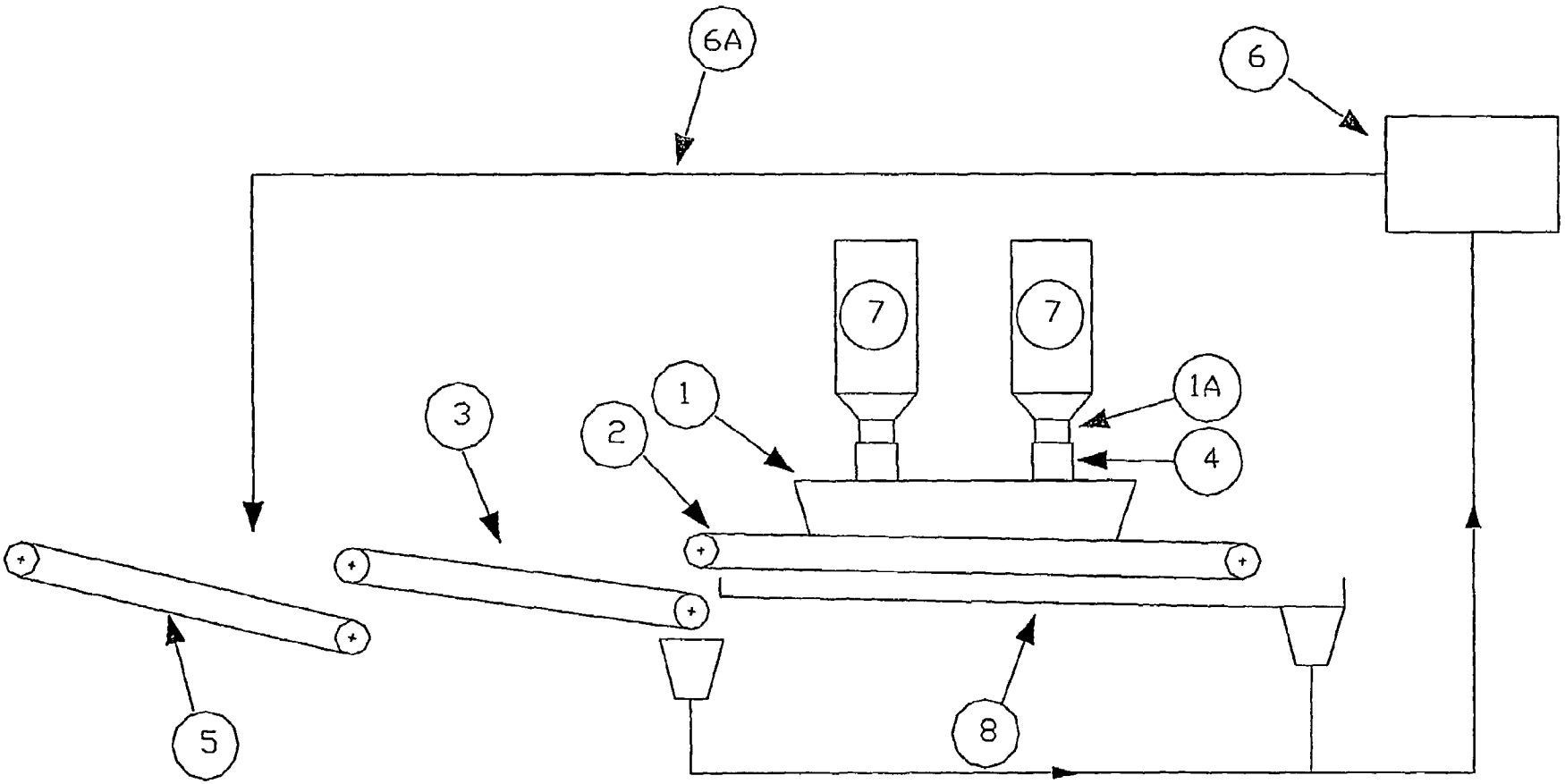
FIG. 1 is a diagrammatic view of the system.

The innovative equipment forming the new process is highlighted in FIG. 1. The belt conveyor 2 is connected to the coking towers 7 first with a hopper 1 having the function of gathering and draining the possible surplus material coming from the tower, then with a pre-crusher 4 which reduces the coke's size to such an extent in order to avoid problems during the following transport phase, and subsequently with a cylindrical connection 1*a* having the function of connecting the crusher to the coking tower's flange during the cutting phase. The cylindrical connection 1*a* between the coking chamber 7 and the crusher 4 is anchored onto the same crusher and it is of the telescopic type controlled by hydraulic pistons. The cylinder is sealed on the bottom tower's flange through an inflatable seal. This makes lateral leakages impossible. When the discharge is started, the belt conveyor 2 moves forward with such a speed so as to guarantee a removal capacity greater than the material's output falling from the coking tower. The belt is equipped with suitable conical drainage holes (not shown), which allow to the aqueous phase to cross the belt's conveying plates and to fall into the lower collection channel 8. The coke transported by the belt 2 is collected by a further draining belt 3 having the function of draining the residual water, and the belt 3 discharges the solid coke onto a rubber belt 5 which sees to transport the coke towards the storage bunkers. All the collection waters 8 get later sent to the filtering system 6 which separates the water from the coke that on its turn is recycled 6*a* on one of the draining belts.

Figure 2:
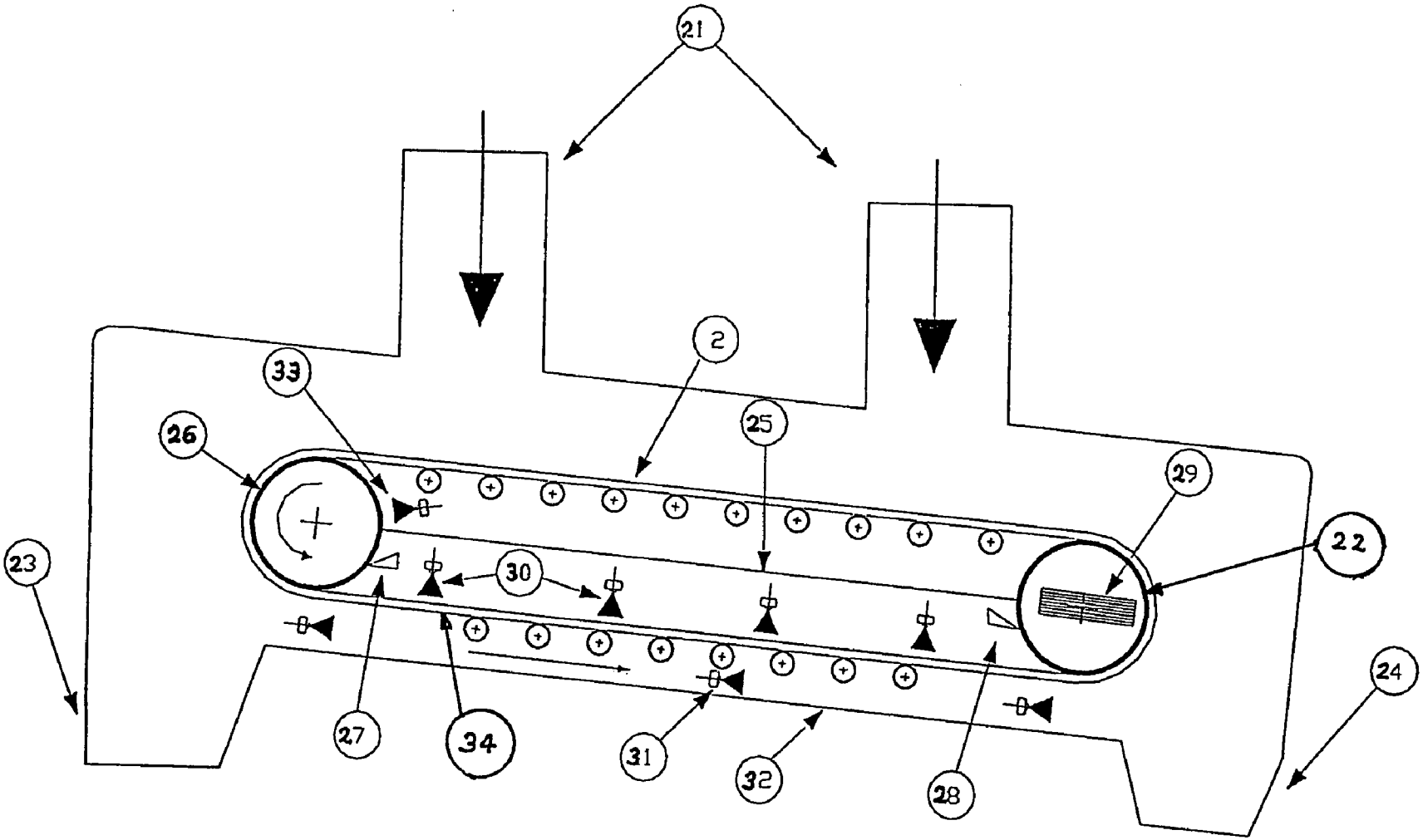
FIG. 2 is a detail of the drainage and extraction device.

In FIG. 2 the drainage device is described which is the main innovation of the whole process. The water/coke mixture coming from the pre-crusher is discharged onto the drilled metal belt conveyor 2 through the openings 21 arranged on the outer housing. The drilled belt conveyor, is placed with a slight slope in order to facilitate the discharge of the water through the hopper 24, while the drained material is discharged from the hopper 23. The entire belt conveyor is contained in a metal casing in order to hold both the drained material and the water.

Referring to FIG. 1, only the belt conveyor 2 is not equipped with a closing plate in the lower part in order to discharge the drained water into the collection channel 8 for its entire length.

The belt conveyor of FIG. 2 is equipped with a number of devices which guarantee its perfect functioning. The drained water from the upper part of the conveyor is collected in an intermediate channel or trough 25 which on its turn is conveyed in the discharging channel 32. The belt conveyor 2 is equipped in the return stretch 34 with a number of nozzles 30 necessary to the belt's cleaning and fit to clean the holes possibly clogged by the coke's fines. Other cleaning nozzles 33, 31 are placed on the traction drum 26 and on the discharging channel 32, respectively.

Such nozzles are needed for coke's fines removal which might get deposited on the surface. For such reason some scrapers 27 and 28 are also provided both on the traction drum 26 and on the tensioning drum 22, respectively. Said scrapers are provided for the material's removal. Another measure used to avoid the accumulation of material on the belt conveyor's rollers is the anti-adherent coating of the bearing rollers and those of the return stretch. The traction drum as well is coated with anti-adherent material in order to avoid the build up of material and to increase the coefficient of friction between the drum and the stainless steel net which forms the driving structure of the belt conveyor. Another device which is part of the belt conveyor is the hydraulic tensioning system 29.

The advantages that are achieved thanks to this innovative process system are:

Reduction of the decoking time, with a resulting increase in the system productivity. The case wherein the coking represents the critical process in a refinery is not rare, placing a limit through its criticality to the production of the refinery itself. Therefore, reducing the coking process time, in these cases, constitutes an extremely interesting perspective. The duration of the decoking phase can be reduced, using the invented process, because currently a limit to the hourly quantity of dischargeable coke from the tower exists due to the presence of the crusher which functions as a bottleneck. The potential accumulation of coke on the crusher's rollers is thus something to avoid as much as possible, because some bridges form over the crusher which later on must be manually removed, with consequent risks for the operators and a reduction of the plant's potentials. In order to avoid such inconveniences, it is thus preferred to maintain a crushing speed (into the coking tower through the water flow drill) much lower than the limit imposed by the crusher. The substitution of the crusher with a pre-crusher, at this time of the process hence allows getting rid of this bottleneck. As a matter of fact, since the coke doesn't need to be hydraulically transported, it is no longer necessary to use a crusher with high reduction ratios. In the case of this inventive application a pre-crusher is utilized with such considerably lower reduction ratios between input and output granulometry so as to achieve remarkable capacities without floodings. From this point of view, theoretically the belt has no limits, because it functions as an extractor.

Elimination of the possibility of clogging due to the crusher. In the proposed process, the pre-crusher does not represent a bottleneck, and a possible slipping of material is effortlessly removed.

Elimination of a further water addition: currently, due to the need of facilitating the coke's outflow as well as to the fact that the coke is hydraulically transported, a further amount of water gets added to the coke falling from the tower (with about two parts of water for every coke one), in order to reach a transported slurry which consists of about 3÷4 parts of water for one of coke. This makes the following coke's drainage phase extremely more difficult. In the proposed process, the water that must be removed from the coke is only that necessary to the coke's cutting. In addition, the drainage on the belt is also made easier by the fact that thanks to the innovative system, the coke gets instantly drained on the belt while before it remained in contact with the water for a much longer time since it was hydraulically transported, thus absorbing more water.

Elimination of the hydrobins: a consequence of what has been said in the previous paragraph is the complete elimination of the whole drainage operation which takes place in the hydrobins, with the resulting savings in plant engineering, as well as in operation and maintenance costs (an expensive and complex plant would be entirely eliminated).

The invention claimed is:

1. A system for extraction, drainage and wet transport of petroleum coke produced by coking chambers and comprising a pre-crusher (4), a containment and drainage hopper (1), a connection system (1*a*) between tower (7) and pre-crusher (4), a draining-extracting belt (2), a water collection system (8), a further draining belt (3) for completing the residual water drainage, and a rubber belt (5) for the ultimate transport to storage.

2. The system for petroleum coke extraction and drainage according to claim 1, wherein a filtering system (6) for the collected water is situated downstream from the water collection system (8).

3. The system for petroleum coke extraction and drainage according to claim 2, wherein a drained coke recycle system (6*a*) is provided downstream from filtering system (6) for recycling separated coke to one of the draining belts or directly to the storage.

4. The system for petroleum coke extraction and drainage according to claim 1, wherein the draining-extracting belt (2) is a belt conveyor with conical holes for the petroleum coke's water drainage and extraction coming from the coking chamber, fit to drain the water through the conical holes and to transport drained coke towards a discharging hopper (23).

5. A system for extraction, drainage and wet transport of petroleum coke produced by the coking chambers and comprising a pre-crusher (4), a containment and drainage hopper (1), a connection system (1*a*) between a tower (7) and the pre-crusher (4), a draining-extracting belt (2) which is a drilled belt conveyor with conical drainage holes for the petroleum coke's water drainage and extraction coming from the coking chamber, fit to drain the water through the conical holes and to transport the drained coke towards the discharging hopper (23); a water collection system (8), a further draining belt (3) for completing residual water drainage, and a rubber belt (5) for the ultimate transport to the storage; wherein said belt conveyor is equipped with a high pressure nozzle system (33, 30, 31) for cleaning of a traction drum (26), of a return stretch (34) of the belt conveyor and of collection channel (32), respectively.

6. The system for petroleum coke extraction and drainage according to claim 5, wherein said traction drum (26) and belt conveyor's rollers are equipped with a coating which avoids coke's fines adhesion.

7. The system for petroleum coke extraction and drainage according to claim 6, wherein said coating of the traction drum (26) also increases the coefficient of friction between said drum and the belt conveyor's metal net.

8. The system for petroleum coke extraction and drainage according to claim 5, wherein said belt conveyor is equipped with a collection system (25) for drained water to be sent to collection system (8).

9. The system for petroleum coke extraction and drainage according to claim 5, wherein said belt conveyor is equipped with a hydraulic system (29) for tensioning of the corresponding drum (22).

10. The system for petroleum coke extraction and drainage according to claim 6, wherein scrapers (27, 28) are provided on traction drum (26) and tensioning drum (22), respectively, for removal of coke fines.

* * * * *

UNITED STATES PATENT AND TRADEMARK OFFICE

CERTIFICATE OF CORRECTION

PATENT NO. : 7,468,118 B2
APPLICATION NO. : 10/501013
DATED : December 23, 2008
INVENTOR(S) : Mario Magaldi et al.

It is certified that error appears in the above-identified patent and that said Letters Patent is hereby corrected as shown below:

Column 2,
Line 22, after "invention's" insert:
-- system is explained in an explanatory but not limiting way, with reference to the --.

Signed and Sealed this

Sixteenth Day of November, 2010

David J. Kappos

David J. Kappos
*Director of the United States Patent and Trademark Office*